US007469439B2

(12) United States Patent
Tokuno et al.

(10) Patent No.: US 7,469,439 B2
(45) Date of Patent: Dec. 30, 2008

(54) FLOOR SLAB BRIDGE STRUCTURE

(75) Inventors: Mitsuhiro Tokuno, Ishikawa-ken (JP); Fumihiro Saito, Ishikawa-ken (JP)

(73) Assignees: Asahi Engineering Co., Ltd., Ishikawa-ken (JP); Eco Japan Co., Ltd., Ishikawa-ken (JP)

( * ) Notice: Subject to any disclaimer, the term of this patent is extended or adjusted under 35 U.S.C. 154(b) by 0 days.

(21) Appl. No.: 11/585,958

(22) Filed: Oct. 25, 2006

(65) Prior Publication Data

US 2007/0251031 A1 Nov. 1, 2007

(30) Foreign Application Priority Data

Feb. 13, 2006 (JP) ..... 2006-035690

(51) Int. Cl.
*E01D 19/12* (2006.01)

(52) U.S. Cl. ..... 14/73; 14/75; 14/77.3

(58) Field of Classification Search ..... 14/77.3, 14/74.5, 75, 77.1, 73; 52/414, 252, 258, 52/259, 319, 340, 262, 432
See application file for complete search history.

(56) References Cited

U.S. PATENT DOCUMENTS 6,449,791 B1 * 9/2002 Vodicka ..... 14/75
6,792,638 B2 * 9/2004 Tokuno et al. ..... 14/73
2004/0221533 A1 * 11/2004 Tokuno et al. ..... 52/506.01

FOREIGN PATENT DOCUMENTS

JP 2000-319816 11/2000
JP 2000319816 A * 11/2000
JP 2004278148 A * 10/2004
JP 2004300914 A * 10/2004
JP 2007-231583 9/2007

OTHER PUBLICATIONS

"Rigid Frame Bridges" publication http://web.archive.org/web/20030502150815/http://www.sha.state.md.us/keepingcurrent/maintainRoadsBridges/bridges/oppe/historicBridges/IX-RgdFr.pdf (May 2, 2003).*
Machine-generated English translation of JP 2000-319816, published Nov. 21, 2000.

* cited by examiner

*Primary Examiner*—Raymond W Addie
(74) *Attorney, Agent, or Firm*—Wenderoth, Lind & Ponack, L.L.P.

(57) ABSTRACT

A floor slab bridge structure is capable of enhancing the strength with which bridge girders and concrete bridge piers are rigidly joined so as to effectively suppress expansion and contraction, deflection, and distortion of the bridge girders, and to synergistically enhance the strength of connection concrete itself against the expansion and contraction, distortion, etc., to thereby be effective to prevent collapse of a bridge due to a large earthquake. Slab concrete is hammer-set between sides of respective bridge girders, which are spaced apart in a bridge width direction, along a length direction of the bridge girders. Connection concrete, in which bridge girder portions supported on bridge bottom surfaces of concrete bridge piers supporting the bridge girders are embedded, is additionally deposited on the bridge bottom surfaces to form a floor slab bridge structure constituting a rigid joining structure. The slab concrete and the concrete bridge piers are thus joined together through the connection concrete.

16 Claims, 9 Drawing Sheets

FLOOR SLAB BRIDGE STRUCTURE

BACKGROUND OF THE INVENTION

1. Field of the Invention

The present invention relates to a floor slab bridge structure formed by hammer-setting slab concrete between sides of respective bridge girders, which are aligned in a bridge width direction, in a length direction of the bridge girders and comprising a composite structure of the bridge girders and the slab concrete.

2. Description of Related Art

Conventional floor slab bridges adopt a flexible joining structure, in which bridge girders are supported on bridge bottom surfaces of concrete bridge piers through rubber bearings and expansion and contraction, deflection, or distortion of the bridge girders are absorbed by the rubber bearings.

However, such flexible joining structure involves a problem that there is a fear of bridge collapse due to a large earthquake, and rubber bearings suffer degradation in function due to age deterioration and are very expensive.

On the other hand, Patent Document 1 (JP-A-2000-319816) proposes, as a method of construction in place of the flexible joining structure with the rubber bearings, a method of construction in which bridge girders are supported on bridge bottom surfaces of concrete bridge piers through non-rubber bearing. Connection concrete is additionally deposited on the bridge bottom surfaces, and bridge girder portions are embedded in the connection concrete, to thereby form a rigid joining structure of the bridge girders and the individual bridge piers.

However, the method of construction, in which rigid joining is achieved through independent connection concrete additionally deposited on the individual concrete bridge piers, is not functionally effective to provide strength for expansion and contraction, distortion, etc. of bridge girders extending between bridge piers, and to ensure the strength of independent connection concrete itself for expansion and contraction, distortion, etc. of bridge girders. Therefore, with such independent connection concrete, stress concentration and cracks or the like are generated in the bridge girders and the independent connection concrete such that the structure does not effectively function as an earthquake resistant structure against a large earthquake.

SUMMARY OF THE INVENTION

The invention provides a floor slab bridge structure wherein slab concrete is hammer-set between sides of respective bridge girders, which are spaced apart in a bridge width direction and extend along a bridge length direction to form a floor slab composed of a composite structure of the bridge girders and the slab concrete. Connection concrete, in which bridge girder portions supported on bridge bottom surfaces of concrete bridge piers supporting the bridge girders are embedded, is additionally deposited on the bridge bottom surfaces to form a rigid joining structure. The slab concrete and the concrete bridge piers are concrete-joined together through the connection concrete.

A rigid joining structure is constructed by providing the concrete bridge piers upright on buried foundation pillars, or by striking sheet piles in opposition to a bank while assembling them to construct an earth-retaining wall connected in a bridge width direction, supporting the concrete bridge piers on upper ends of the sheet piles projecting above the surface of the water or the ground, and concrete-joining the bridge piers and the slab concrete through the connection concrete.

Also, the bridge girders are supported directly on the bridge bottom surfaces of the concrete bridge piers, or supported indirectly on sleeper materials provided on the bridge bottom surfaces, and the sleeper materials are embedded in the connection concrete. As the sleeper materials, it is possible to use concrete sleeper materials hammer-set and formed on the bridge bottom surfaces of the concrete bridge piers, or steel materials, etc.

Also, as means for reinforcement of a concrete joining structure with the connection concrete, the bridge girder portions supported on the bridge bottom surfaces of the concrete bridge piers and the concrete bridge piers are connected to each other by connecting bars, which are inserted and embedded in the bridge piers and the connection concrete.

In the invention, the term "bridge piers" generally refers to an abutment and a bridge pier.

According to the invention, the connection concrete and the slab concrete cooperate with each other to form a gate type Rahmen structure. It is possible to enhance the strength, with which the bridge girders and the concrete bridge piers are rigidly joined by the connection concrete, to effectively suppress the expansion and contraction, deflection, and distortion of the bridge girders, and to synergistically enhance the strength of the connection concrete itself against the expansion and contraction, distortion, etc. Therefore, the structure is very effective to prevent bridge collapse due to a large earthquake.

DESCRIPTION OF PREFERRED EMBODIMENTS

Embodiments of the invention will be described below with reference to FIGS. 1 to 9.

Figure 1:
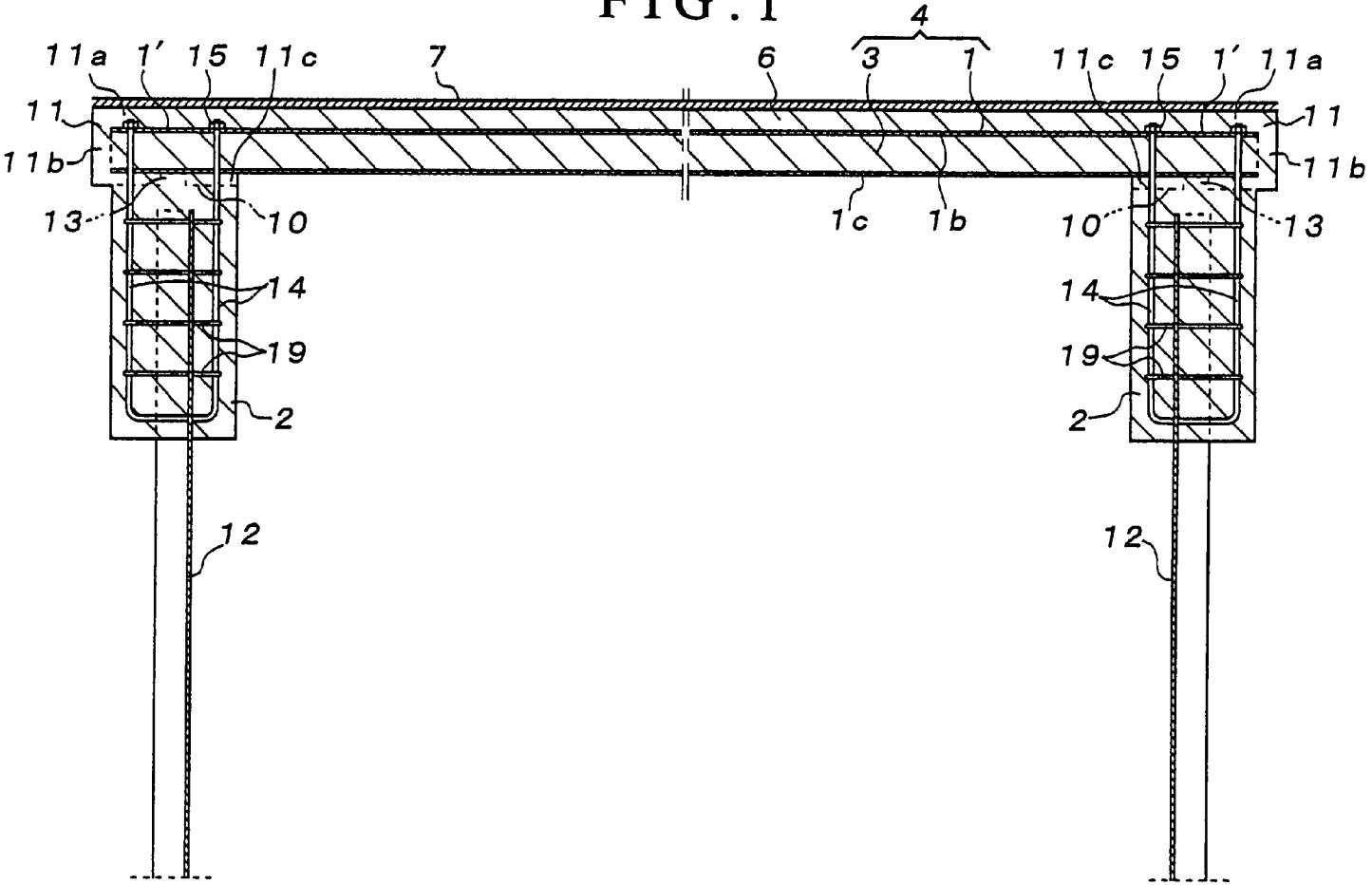
FIG. 1 is a view showing a floor slab bridge, according to the invention, as viewed in cross section on a surface of a bridge girder in a bridge length direction.
Figure 3:
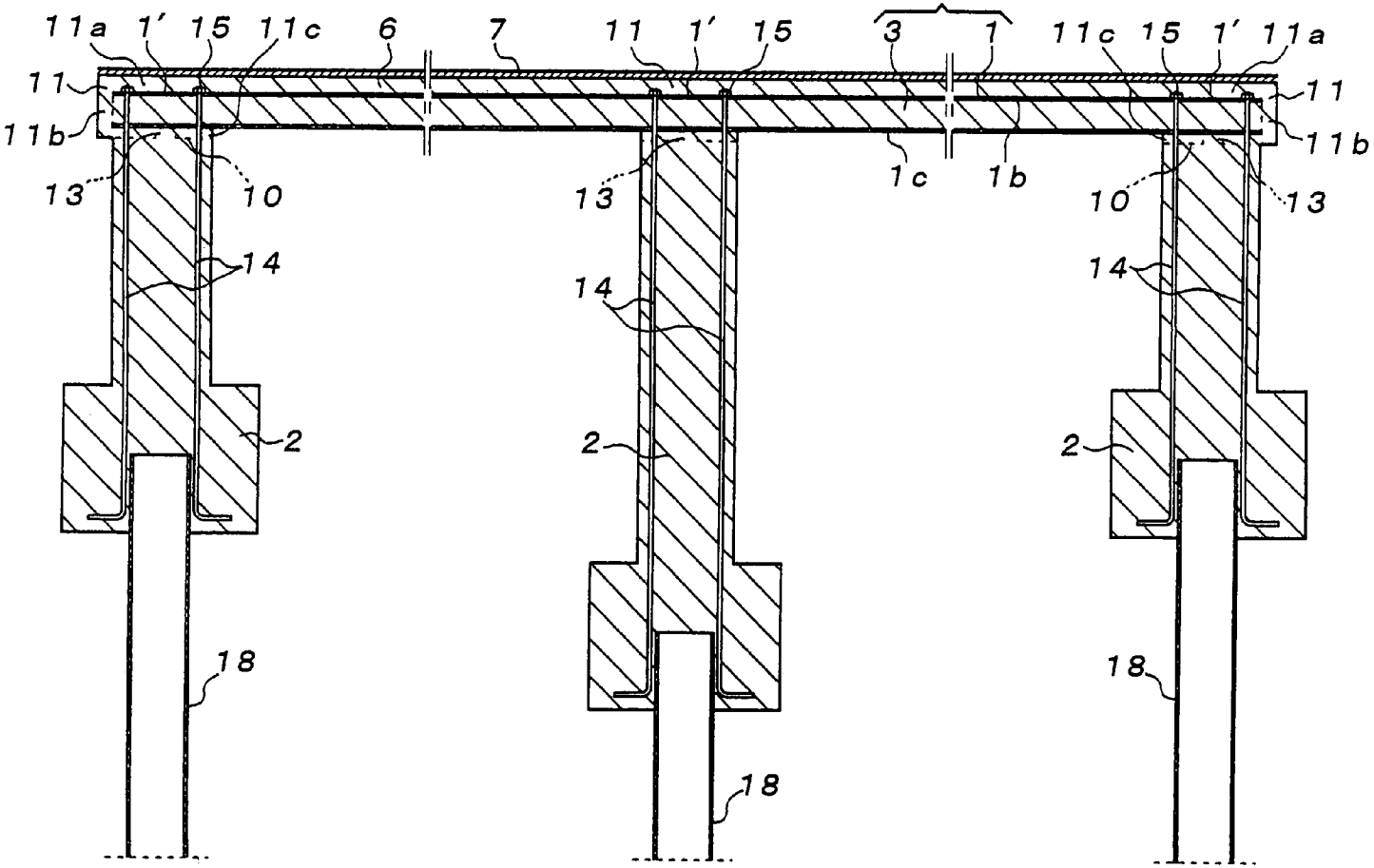
FIG. 3 is a view showing a further example of a floor slab bridge, according to the invention, as viewed in cross section on a surface of a bridge girder in a bridge length direction.
Figure 5:
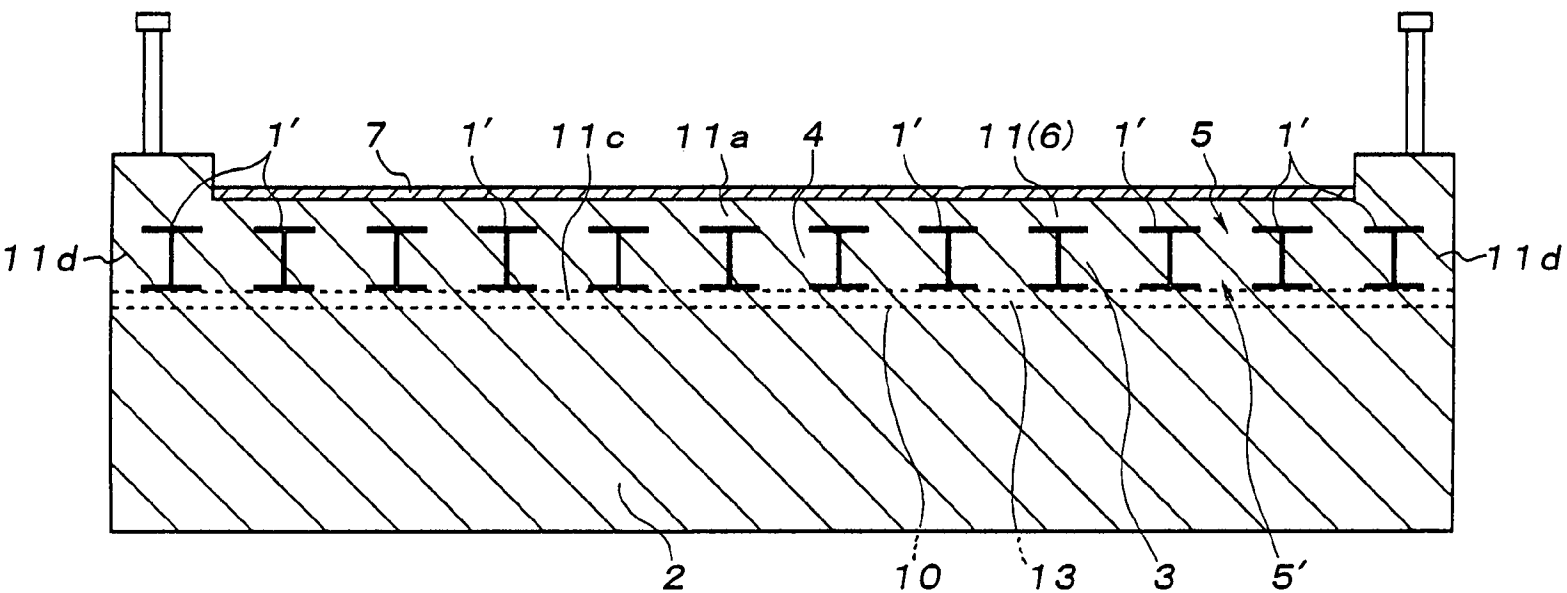
FIG. 5 is a cross sectional view showing a floor slab bridge in a bridge width direction.

As shown in FIGS. 1, 3, 5, and the like, a plurality of bridge girders 1 are spaced apart in a bridge width direction and supported on bridge piers 2 spaced apart in a bridge length direction. Slab concrete 3 is hammer-set and formed between sides of the respective bridge girders 1 along a length direction of the bridge girders 1. A floor slab 4 is composed of a composite structure of the bridge girders 1 and the slab concrete 3.

FIG. 1 shows a single span floor slab bridge comprising bridge piers 2, which are respectively mounted on opposite banks of a river and on which both ends of bridge girders 1 are supported, and FIG. 3 shows a plural span floor slab bridge comprising bridge piers 2, which support end and intermediate portions of the bridge girders 1. The present invention encompasses the single span floor slab bridge and the plural span floor slab bridge.

The bridge girders 1 each comprise a steel girder or a concrete girder, and as a preferred example, a floor slab 4 composed of a composite structure of bridge girders 1 and a slab concrete 3 is formed by using H-steel bridge girders 1, which each comprise an upper flange 1*b* at an upper end of a web plate 1*a* and a lower flange 1*c* at a lower end thereof, and hammer-setting concrete in spaces defined by the upper and lower flanges 1*b*, 1*c* and the web plates 1*a* between adjacent bridge girders 1 in the bridge width direction to form a slab concrete 3.

Upper openings 5 extending in a bridge length direction are provided between adjacent, upper flanges 1*b*, lower openings 5' extending between the adjacent, lower flanges 1*c* in the bridge length direction are closed by closure members, and concrete is hammer-set, that is, filled in the spaces through the upper openings 5 to form the slab concrete 3.

The closure members that close the lower openings 5' are removed or caused to remain as they are, after the slab concrete 3 is formed. In those regions, in which a connection concrete 11 (described later) is hammer-set and which face a bridge bottom surface 10 of a bridge pier 2, however, concrete is hammer-set in spaces between the bridge girders without closing the lower openings 5' whereby a slab concrete 3 is formed and simultaneously therewith a part of the concrete is caused to flow out toward the bridge bottom surface 10 through the lower openings 5' to be concrete-joined to the bridge bottom surface 10.

Simultaneously, roadbed concrete 6 joined integrally is hammer-set through the upper openings 5 and formed on all the upper flanges 1*b*, and road pavement 7 is applied to an upper surface of the roadbed concrete 6.

Longitudinal reinforcing bars 16 extending in the bridge length direction and transverse reinforcing bars 8 extending in the bridge width direction are assembled together in the roadbed concrete 6. That is, the longitudinal reinforcing bars 16 and the transverse reinforcing bars 8 are assembled together to be placed on the upper flanges 1*b*, and suspended reinforcing bars 9 assembled with the transverse reinforcing bars 8 or the longitudinal reinforcing bars 16 are suspended and embedded in the slab concrete 3 through the upper openings 5.

The suspended reinforcing bars 9, for example, are bent in a U-shape with both arms thereof assembled with the transverse reinforcing bar 8, and are bent in an inverted U-shape to form a suspended reinforcing bar 9' with a connecting portion of the suspended reinforcing bar 9' assembled with the longitudinal reinforcing bars 16 or the transverse reinforcing bar 8 and with both arms thereof inserted through at least the upper flange 1*b* of the bridge girder 1 to be embedded in the slab concrete 3.

Longitudinal reinforcing bars 16' are assembled with the suspended reinforcing bars 9 or 9' to be embedded in the slab concrete 3, and web insertion rods 17 inserted through all the web plates 1*a* are embedded in the slab concrete 3.

Stated again, the H-steel bridge girders, or T-steel bridge girders, or I-steel bridge girders, which are made of a steel material, various concrete bridge girders, etc. are used as the bridge girders 1 and spaces are provided between the respective bridge girders 1 to form upper openings 5 between upper ends of adjacent bridge girders 1. Concrete is hammer-set, that is, filled in the spaces to form the slab concrete 3, and simultaneously therewith, roadbed concrete 6 joined integrally is hammer-set through the upper openings 5 and formed on upper surfaces of all the bridge girders 1 to construct road pavement 7 on an upper surface of the roadbed concrete 6. Then the longitudinal reinforcing bars 16 and the transverse reinforcing bars 8 placed on upper end surfaces of all the bridge girders 1 are embedded in the roadbed concrete 6, the suspended reinforcing bars 9, 9' are suspended and embedded in the slab concrete 3, and web insertion rods 17 inserted through webs of all the bridge girders 1 are embedded in the slab concrete 3.

Of course, a multiplicity of the suspended reinforcing bars 9, 9', the transverse reinforcing bars 8, and the web insertion rods 17 are arranged at intervals in the bridge length direction and a multiplicity of the longitudinal reinforcing bars 16, 16' are arranged at intervals in the bridge width direction.

Figure 2:
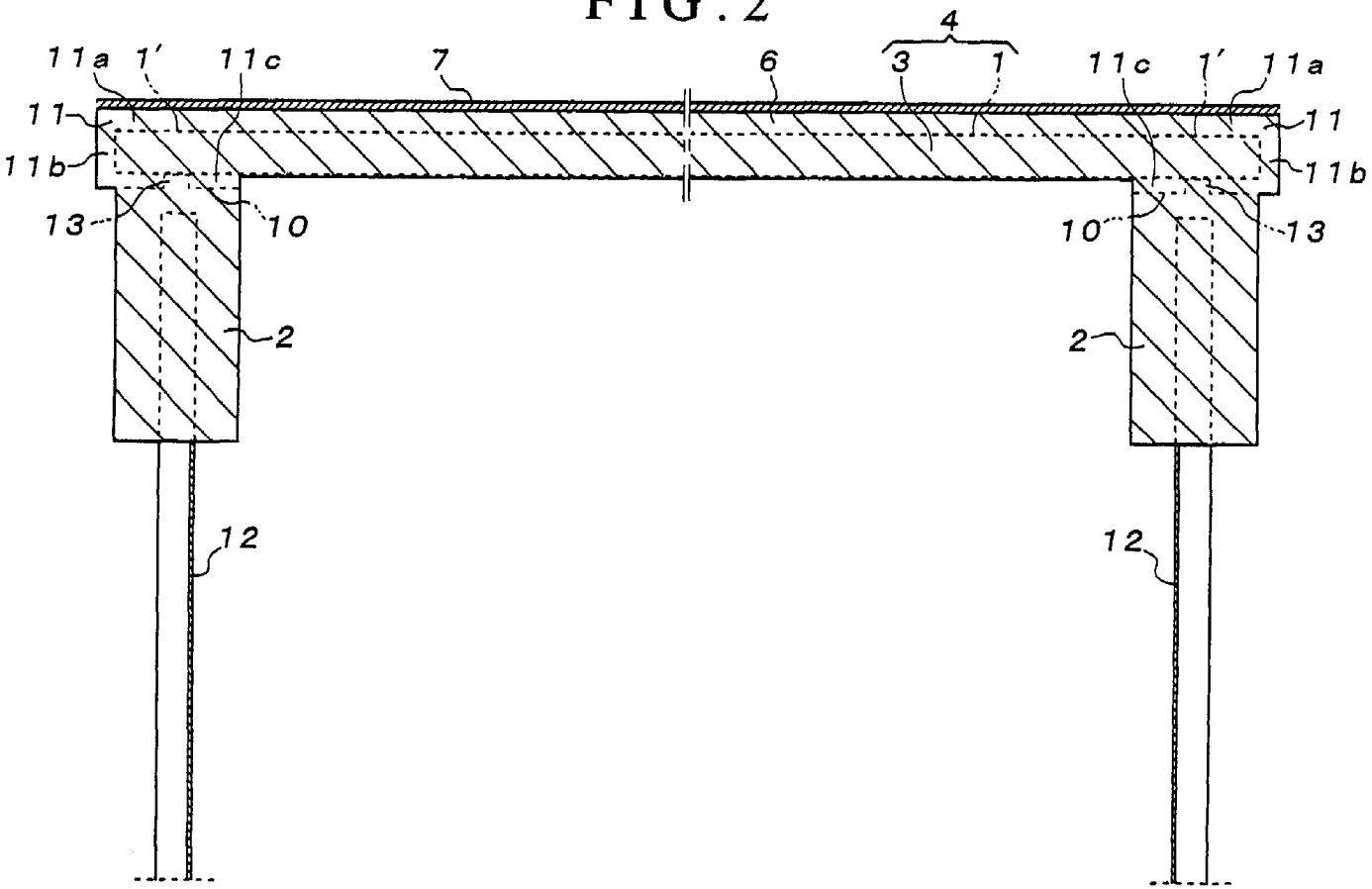
FIG. 2 is a view showing the floor slab bridge as viewed in cross section on a surface of a slab concrete in the bridge length direction.
Figure 4:
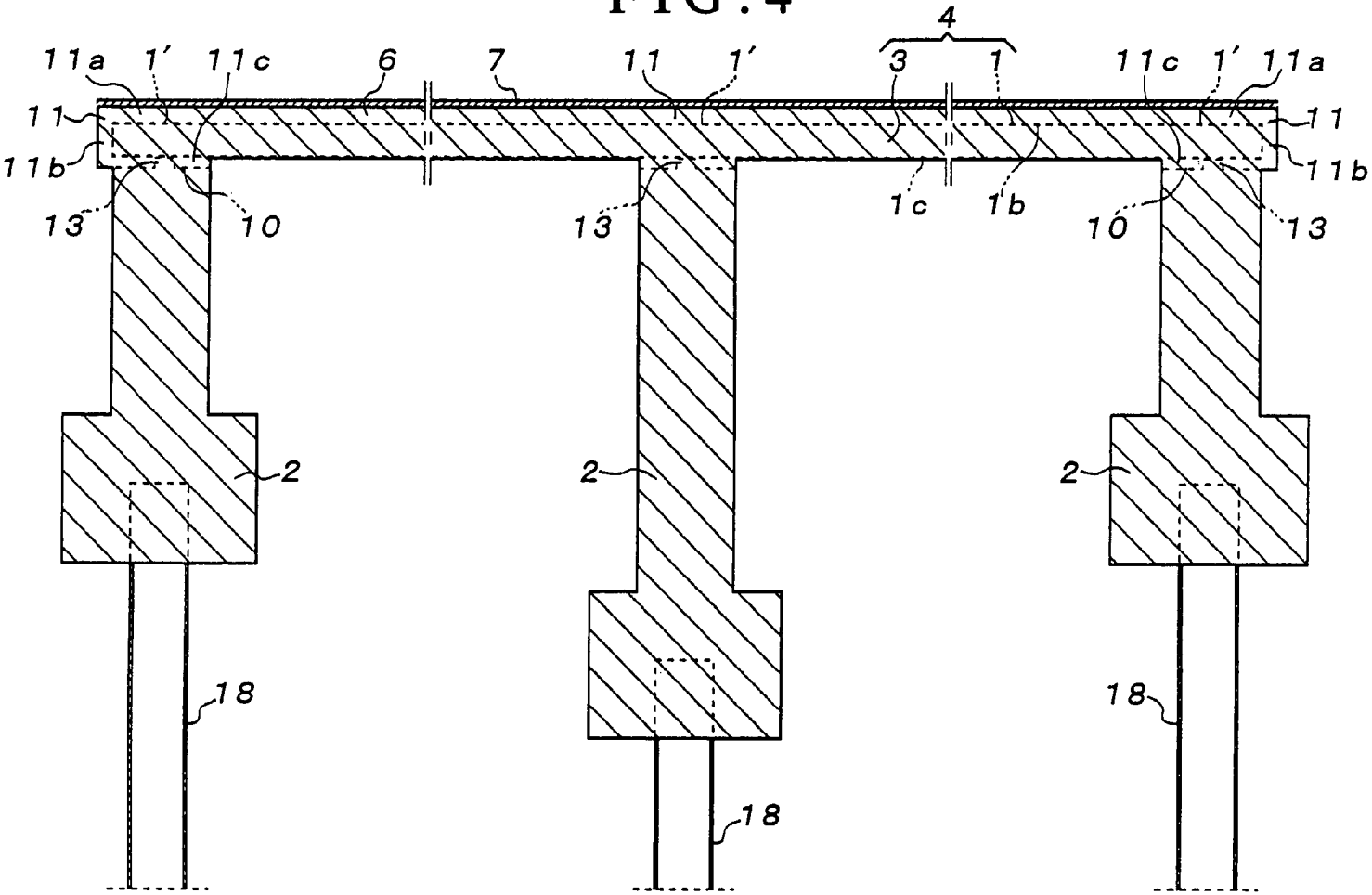
FIG. 4 is a view showing a further example of a floor slab bridge as viewed in cross section on a surface of a slab concrete in the bridge length direction.
Figure 6:
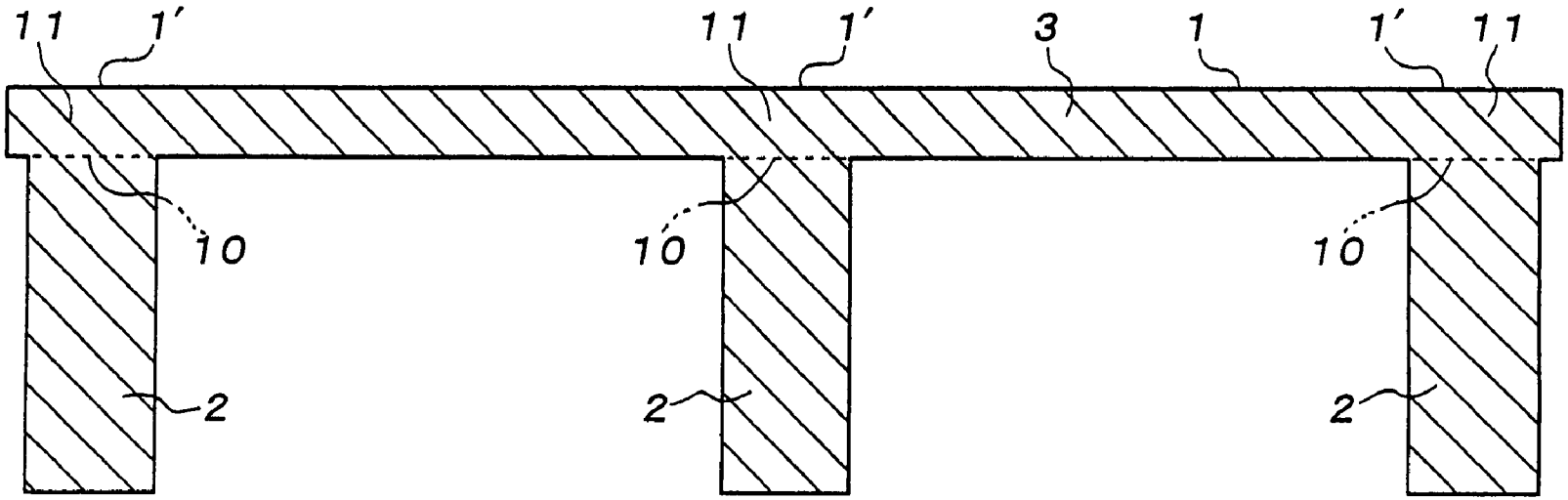
FIG. 6 is a cross sectional view showing a gate type Rahmen structure formed by slab concrete, connection concrete, and concrete bridge girders on a floor slab bridge.

Further, a connection concrete 11, in which bridge girder portions 1' supported on bridge bottom surfaces 10 of concrete bridge piers 2 supporting lower end surfaces of the bridge girders 1 are embedded, is additionally deposited on the bridge bottom surfaces 10 to form a rigid joining structure of a gate type Rahmen, in which the slab concrete 3 and the concrete bridge piers 2 are concrete-joined together through the connection concrete 11, and the bridge girders 1 are joined to the bridge piers 2 through the slab concrete 3 and the connection concrete 11 as shown in FIGS. 2, 4, 6 or the like.

That is, after the concrete bridge piers 2 are constructed, the lower end surfaces of the bridge girders 1 are supported on the bridge bottom surfaces 10, and in the case of H-steel bridge girders 1, lower flanges 1*c* thereof are supported on the bridge bottom surfaces 10, and the connection concrete 11 is hammer-set and formed on the bridge bottom surfaces 10.

As shown in FIGS. 2 and 4, the connection concrete 11 is concrete-joined to the slab concrete 3 through the upper openings 5 of the bridge girders 1 by making the concrete bridge piers 2 substantially bulky, and covering upper surfaces of the bridge girder portions 1', or upper surfaces of the upper flanges 1*b* in the case of H-steel bridge girders 1, with a top 11*a* of the connection concrete 11, that is, embedding upper ends (the upper flanges 1*b*) of the bridge girders 1 in the top 11*a* of the connection concrete 11. The top 11*a* of the connection concrete 11 constitutes a part of the roadbed concrete 6.

Figure 7:
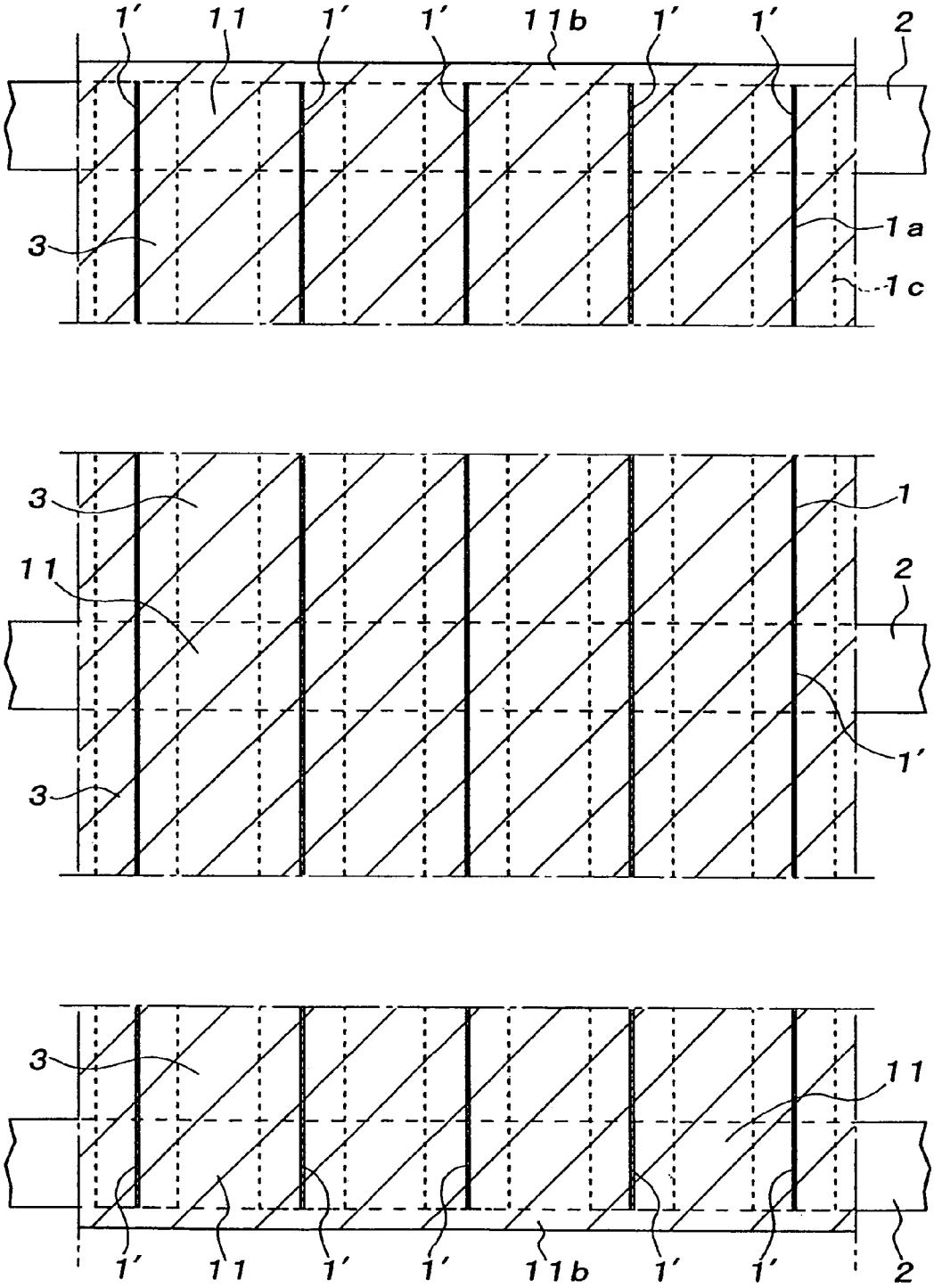
FIG. 7 is a view showing a floor slab bridge as viewed in cross section on a horizontal surface.

Further, as clearly shown in FIGS. 2, 4, and 7, bridge girder end surfaces of bridge length ends are covered by rear sides 11*b* of the connection concrete 11. That is, the bridge girder end surfaces are embedded in the rear sides 11*b*, and the connection concrete is concrete-joined to the slab concrete 3 through end openings at the bridge girder end surfaces. The slab concrete 3 on the bridge girder portions 1' constitutes a part of the connection concrete 11.

Further, outer side surfaces of the bridge girder portions 1' in the bridge width direction are covered with left and right sides 11*d* of the connection concrete 11 in the bridge width direction. That is, the outer side surfaces are embedded in the left and right sides 11*d* of the connection concrete 11.

Therefore, there is provided a structure, in which the floor slab 4 of the composite structure is bridged and connected between respective portions of the connection concrete 11.

As shown in FIG. 3, the concrete bridge piers 2 are provided upright on buried foundation pillars 18, and as described above, a gate type Rahmen structure is constructed, in which the connection concrete 11 concrete-joins (rigidly joins) between the bridge piers 2 and the slab concrete 3, and the bridge girders 1 are rigidly joined to the bridge piers 2 through the slab concrete 3 and the connection concrete 11.

Also, as shown in FIG. 1, a gate type Rahmen structure is constructed in a unique method of construction by striking sheet piles 12 in opposition to a bank while assembling them to construct an earth-retaining wall connected in the bridge width direction, supporting the concrete bridge piers 2 on upper ends of the sheet piles 12 projecting above the surface of the water or the ground, concrete-joining (rigidly joining) the bridge piers 2 and the slab concrete 3 through the connection concrete 11, and rigidly joining the bridge girders 1 to the bridge piers 2 through the slab concrete 3 and the connection concrete 11.

A structure is provided, in which steel sheet piles made of a steel sheet having joints on both side edges as shown in the figure are used as the sheet piles 12, a multiplicity of the sheet piles 12 are connected together by the joints and struck to form a sheet pile base and the earth-retaining wall, and the concrete bridge piers 2 are supported on an upper end of the sheet pile base.

Alternatively, a structure is provided, in which a multiplicity of sheet piles 12 made of a steel column or a concrete column are struck to form a sheet pile base and the earth-retaining wall, and the concrete bridge piers 2 are supported on an upper end of the sheet pile base.

The bridge girders 1 are supported directly on the bridge bottom surfaces 10 of the concrete bridge piers 2, or sleeper materials 13 are provided on the bridge bottom surfaces 10 and the bridge girders 1 are supported on the sleeper materials 13, that is, the bridge girders 1 are supported indirectly on the bridge bottom surfaces 10 through the sleeper materials 13, and the sleeper materials 13 are embedded in the connection concrete 11.

Stated in detail, concrete hammer-set through the upper openings 5 is filled in the spaces between the bridge girders to form the slab concrete 3 and to simultaneously flow onto the bridge bottom surfaces 10 through the lower openings 5' to concrete-join the slab concrete 3 with the concrete bridge piers 2.

Accordingly, the connection concrete 11 hammer-set and formed on the bridge girder portions 1' on the bridge piers 2 constitutes a part of the slab concrete 3.

Spaces are defined between the floor slab 4 and the bridge bottom surfaces 10 by interposing the sleeper materials 13 therebetween, connection concrete 11 is filled in the spaces through the lower openings 5' to be concrete-joined to the bridge bottom surfaces 10, and a bottom 11*c* of the connection concrete 11 filled in the spaces covers lower surfaces of the bridge girder portions 1', or lower surfaces of lower flanges 1*c* in case of H-steel bridge girders. That is, the lower flanges 1*c* are embedded in the bottom 11*c* of the connection concrete 11 and simultaneously therewith the sleeper materials 13 are embedded in the bottom 11*c* of the connection concrete 11.

Also, in the case where the sleeper materials 13 are not interposed, a part of the slab concrete 3 flows onto the bridge bottom surfaces 10 through the lower openings 5' to be concrete-joined to the bridge bottom surfaces 10.

Sleeper materials made of H-steel, or sleeper materials made of concrete are used as the sleeper materials 13. As a preferred example, there are provided concrete sleeper materials 13 deposited integrally on the concrete bridge piers 2 from substantially central portions of the bridge bottom surfaces 10.

Further, the sleeper materials 13 are provided independently for each bridge girder 1, and the sleeper materials 13 successively extending in the bridge width direction are provided such that, for example, the concrete sleeper materials 13 successively extending in the bridge width direction are provided integrally with and transversely to the concrete bridge piers 2.

In case of H-steel bridge girders 1, the lower flanges 1*c* are supported directly on the bridge bottom surfaces 10 of the concrete bridge piers 2, or supported on the sleeper materials 13 provided on the bridge bottom surfaces 10. That is, the H-steel bridge girders 1 are supported indirectly on the bridge bottom surfaces 10 through the sleeper materials 13, and the sleeper materials 13 are embedded in the bottom 11*c* of the connection concrete 11.

Connection concrete 11 is filled in spaces defined between the floor slab 4 and the bridge bottom surfaces 10 by the sleeper materials 13. In other words, connection concrete 11 is filled in spaces defined between the lower flanges 1*c* of the H-steel bridge girders and the bridge bottom surfaces 10, through the lower openings 5' to be concrete-joined to the bridge bottom surfaces 10, and the bottom 11*c* of the connection concrete 11 filled in the spaces covers lower surfaces of the bridge girder portions 1', or lower surfaces of the lower flanges 1*c* in case of H-steel bridge girders. That is, the lower flanges 1*c* are embedded in the bottom 11*c* of the connection concrete 11, and simultaneously therewith the sleeper materials 13 are embedded in the bottom 11*c* of the connection concrete 11.

Likewise, in the case where T-steel bridge girders, or I-steel bridge girders, which are made of a steel material, and concrete bridge girders of various configurations are used as the bridge girders 1, the lower end surfaces of the respective bridge girders 1 are supported directly on the bridge bottom surfaces 10 of the concrete bridge piers 2, or the lower end surfaces of the bridge girders 1 are supported on the sleeper materials 13 provided on the bridge bottom surfaces 10. That is, the bridge girders 1 are supported indirectly on the bridge bottom surfaces 10 through the sleeper materials 13. And, concrete is filled in the spaces through the lower openings 5' to embed the sleeper materials 13 in the bottom 11*c* of the connection concrete 11.

Also, as a concrete joining structure with the connection concrete 11, that is, means for reinforcement of a rigid joining structure, the bridge girder portions 1', which are supported on the bridge bottom surfaces 10 of the concrete bridge piers 2 and embedded in the connection concrete 11, and the concrete bridge piers 2 are connected to each other by connecting bars 14, which are embedded in the bridge piers 2 and the connection concrete 11 and made of a connecting wire or connecting pipe member. The connecting bars 14 cooperate with the connection concrete 11 to form the rigid joining structure.

The connecting bars 14 extend longitudinally in the concrete bridge piers 2 substantially over total heights thereof, and upper ends thereof project upward from the bridge bottom surfaces 10, the projecting portions extending through the bridge girder portions 1' and/or a portion corresponding to the slab concrete 3 to be connected to the bridge piers 2.

For example, in the case where the bridge girders 1 comprise H-steel bridge girders, the projecting portions of the connecting bars 14 are inserted through through-holes provided in the lower flanges 1*c* and the upper flanges 1*b*, nuts (stoppers) 15 are threaded onto male threaded portions of the connecting bars 14, which project from upper surfaces of the upper flanges 1*b*, and the nuts 15 are seated on the upper flanges 1*b* to connect the bridge girder portions 1' to the bridge piers 2.

Likewise, in the case where T-steel bridge girders, or I-steel bridge girders, which are made of a steel material, and concrete bridge girders of various configurations are used as the bridge girders 1, upper end projecting portions of the connecting bars 14 are inserted through the upper flanges 1*b* and girder bodies, and stoppers such as the nuts 15, etc. are seated on the upper flanges 1*b* and the girder bodies.

Figure 8:
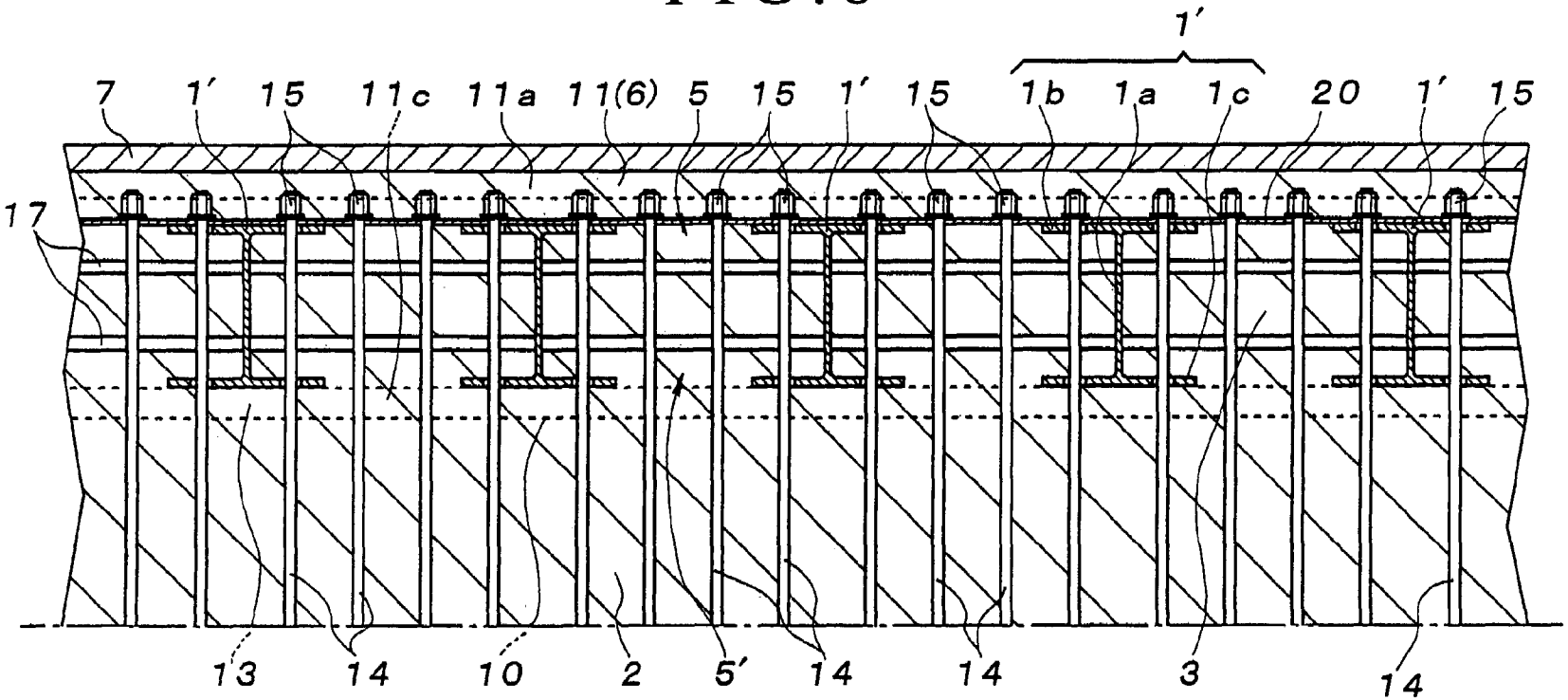
FIG. 8 is a view showing, on an enlarged scale, an essential part of a floor slab bridge as viewed in cross section in a portion of a connection concrete, in which connecting bars are provided.
Figure 9:
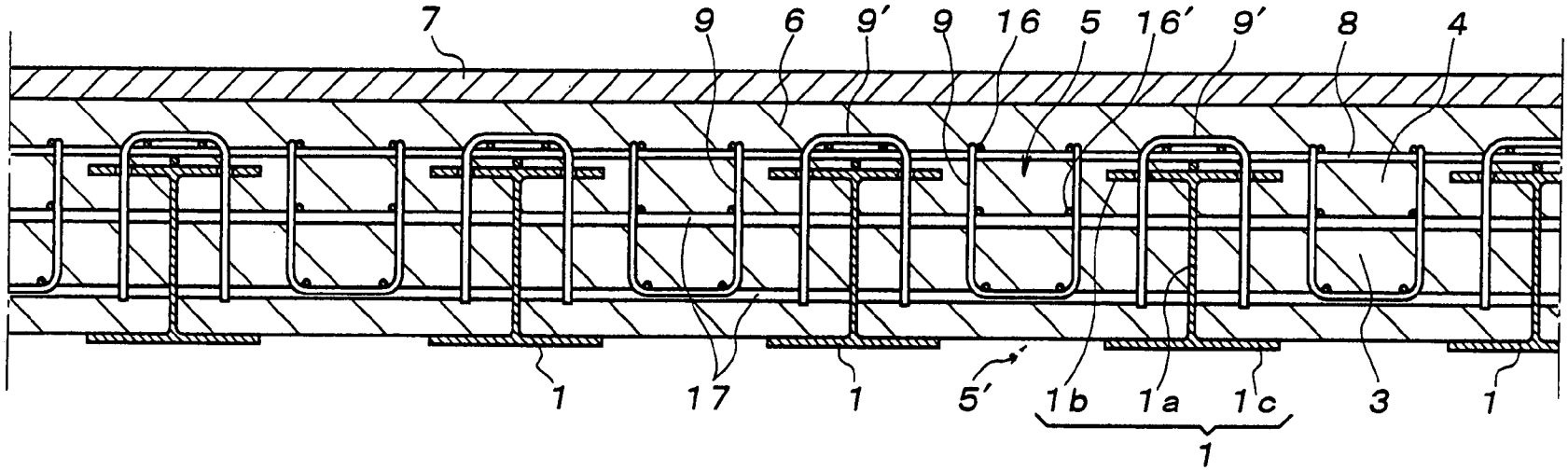
FIG. 9 is a view showing, on an enlarged scale, an essential part of a floor slab bridge as viewed in cross section in a portion of a connection concrete, in which suspended reinforcing bars are provided.

In an example shown in FIG. 8, an elongate seat plate 20 extending in the bridge width direction is mounted on upper surfaces of the bridge girders 1, or upper surfaces of upper flanges 1*b* in the case of H-steel bridge girders, the upper end projecting portions of the connecting bars 14 are inserted through through-holes provided in the elongate seat plate 20, and nuts 15 are threaded onto the upper end projecting portions (male threaded portions) on an upper surface of the seat plate 20 to be seated on the elongate seat plate 20.

In addition, the connecting bars 14 partially extend through that portion of the connection concrete 11, which corresponds to the slab concrete 3, to project upward through the upper openings 5, the upper end projecting portions of the connecting bars 14 are inserted through the through-holes provided in the elongate seat plate 20, and nuts 15 are threaded onto the upper end projecting portions (male threaded portions) on the upper surface of the seat plate 20 to be seated on the elongate seat plate 20.

FIGS. 1 and 3 show specific examples of the connecting bars 14. As illustrated in FIG. 1, for example, a reinforcing bar is bent into a U-shape to form two connecting bars 14 connected to each other, and the respective connecting bars 14 are embedded longitudinally in the concrete bridge piers 2 to be connected to the bridge girder portions 1' with upper ends thereof embedded in the connection concrete 11.

Also, as illustrated in FIG. 3, a plurality of discrete connecting bars 14 are used, and the respective connecting bars 14 are embedded longitudinally in the concrete bridge piers 2 to be connected to the bridge girder portions 1' with upper ends thereof embedded in the connection concrete 11.

Also, in the case where the concrete bridge piers 2 are supported on the upper ends of the sheet piles 12 as shown in FIG. 1, sheet pile connecting reinforcing bars 19 extending through the upper ends of the sheet piles 12 are assembled between two connecting bars 14, which are bent into U-shapes and connected to each other, and the connecting bars 14 and the upper ends of the sheet piles 12 are firmly connected to each other through concrete. That is, the concrete bridge piers 2 are firmly connected to the upper ends of the sheet piles 12 by the connecting bars 14 and the sheet pile-connecting reinforcing bars 19.

Of course, the connecting bars 14 and the sheet pile-connecting reinforcing bars 19 are arranged in plural in the bridge width direction.

The embodiment described above shows the slab concrete 3 in the case where concrete is filled in a whole volume of spaces between adjacent bridge girders 1 as shown in the figure, that is, a whole volume of spaces between side surfaces of the bridge girders 1 and deposited integrally on the roadbed concrete 6.

As a further example, it does not matter whether the slab concrete 3 extending in the bridge length direction is hammer-set and formed only in upper portions of spaces between the bridge girders 1, no concrete is hammer-set in lower portions of the spaces and the lower portions of the spaces are caused to remain in the bridge length direction, or a light-weight material such as foam is filled in the lower portions of the spaces. In either case, the slab concrete 3 continues in spans between the bridge piers 2 and is connected at both ends thereof integrally with the connection concrete 11.

In the case of using, for example, H-steel bridge girders as the bridge girders 1, the slab concrete 3 is filled closely between upper flanges 1*b* and lower flanges 1*c* thereof, or the slab concrete 3 is filled up to upper portions of web plates 1*a* from the upper flanges 1*b* and roadbed concrete 6 is deposited integrally to embed the upper flanges 1*b* in the slab concrete 3 and the roadbed concrete 6 while the lower flanges 1*c* and lower portions of the web plates 1*a* are exposed from the slab concrete 3 to cause lower portions of the spaces, which extend in the bridge length direction, to remain on the lower flanges 1*c*, that is, a lower portion of the slab concrete 3.

In the case where the slab concrete 3 is hammer-set and formed in upper portions of the spaces between the bridge girders 1 to cause lower portions of the spaces to remain, connection concrete 11 is filled in whole spaces between the bridge girders 1 in a region, in which the connection concrete 11 is hammer-set and formed, that is, in a region above the bridge bottom surfaces 10, and a part of the connection concrete 11 is caused to flow onto the bridge bottom surfaces 10 through the lower openings 5' to be concrete-joined.

As described above, the term "concrete bridge piers" 2 generally refers to an abutment and a bridge pier in the preferred form of the invention.

What is claimed is:

1. A floor slab bridge structure comprising:

first and second generally vertically-extending concrete bridge piers, said first and second concrete bridge piers being separated from one another along a bridge-length direction, and each of said first and second concrete bridge piers having a width extending along a bridge-width direction;

a plurality of elongated bridge girders extending in said bridge-length direction and spaced apart from one another in said bridge-width direction, each of said bridge girders having first and second bridge girder support end portions at longitudinally opposite ends thereof, respectively, said first and second bridge girder support end portions being supported on said first and second concrete bridge piers, respectively, such that said bridge girders span between said first and second concrete bridge piers; and bridge concrete including slab concrete disposed in spaces formed between said bridge girders, and connection concrete disposed on said first and second concrete bridge piers;

wherein said first and second bridge girder support end portions of each of said bridge girders are embedded in said connection concrete;

wherein said slab concrete is rigidly joined together with each of said first and second concrete bridge piers by said connection concrete;

wherein first and second connecting bars are respectively embedded in said first and second concrete bridge piers and extend upwardly therefrom;

wherein said first and second connecting bars extend upwardly and respectively project through said first and second bridge girder support end portions of said bridge girders; and wherein first and second stoppers are respectively provided at upper end portions of said first and second connecting bars, said first and second stoppers being respectively secured to said upper end portions of said first and second connecting bars and being respectively engaged with upper sides of said bridge girders to anchor and connect each of said bridge girders to said first and second concrete bridge piers.

2. The floor slab bridge structure according to claim 1, wherein said stoppers comprise nuts threaded onto threaded portions of said upper end portions of said first and second connecting bars.

3. The floor slab bridge structure according to claim 2, further comprising first and second sheet piles, said first and second concrete bridge piers being respectively supported on upper ends of said first and second sheet piles, respectively.

4. The floor slab bridge structure according to claim 3, further comprising sleeper materials provided on each of said first and second concrete bridge piers and interposed between each of said first and second concrete bridge piers and each of said bridge girders so as to support each of said bridge girders on said first and second concrete bridge piers, said sleeper materials being embedded in said connection concrete.

5. The floor slab bridge structure according to claim 4, wherein said sleeper materials are constituted by one of steel and concrete;

said sleeper materials serve to raise said bridge girders from said first and second concrete bridge piers so as to form spaces between said bridge girders and each of said first and second concrete bridge piers; and said spaces formed between said bridge girders and each of said first and second concrete bridge piers by said sleeper materials are filled by said connection concrete so as to embed said sleeper materials in said connection concrete.

6. The floor slab bridge structure according to claim 1, further comprising first and second sheet piles, said first and second concrete bridge piers being respectively supported on upper ends of said first and second sheet piles.

7. The floor slab bridge structure according to claim 6, further comprising sleeper materials provided on each of said first and second concrete bridge piers and interposed between each of said first and second concrete bridge piers and each of said bridge girders so as to support said bridge girders on said first and second concrete bridge piers, said sleeper materials being embedded in said connection concrete.

8. The floor slab bridge structure according to claim 7, wherein said sleeper materials are constituted by one of steel and concrete;

said sleeper materials serve to raise said bridge girders from said first and second concrete bridge piers so as to form spaces between said bridge girders and each of said first and second concrete bridge piers; and said spaces formed between said bridge girders and each of said first and second concrete bridge piers by said sleeper materials are filled by said connection concrete so as to embed said sleeper materials in said connection concrete.

9. The floor slab bridge structure according to claim 1, further comprising sleeper materials provided on each of said first and second concrete bridge piers and interposed between each of said first and second concrete bridge piers and each of said bridge girders so as to support each of said bridge girders on said first and second concrete bridge piers, said sleeper materials being embedded in said connection concrete.

10. The floor slab bridge structure according to claim 9, wherein said sleeper materials are constituted by one of steel and concrete;

said sleeper materials serve to raise said bridge girders from said first and second concrete bridge piers so as to form spaces between said bridge girders and each of said first and second concrete bridge piers; and said spaces formed between said bridge girders and each of said first and second concrete bridge piers by said sleeper materials are filled by said connection concrete so as to embed said sleeper materials in said connection concrete.

11. The floor slab bridge structure according to claim 1, further comprising a seat plate disposed on at least one of said bridge girders between said at least one of said bridge girders and at least one of said stoppers.

12. The floor slab bridge structure according to claim 1, further comprising a third generally vertically-extending concrete bridge pier disposed between said first and second concrete bridge piers;

wherein each of said elongated bridge girders includes a bridge girder support middle portion located between said first and second bridge girder support end portions and supported on said third concrete bridge pier.

13. The floor slab bridge structure according to claim 12, wherein for each of said bridge girders, said bridge girder support middle portion is embedded in said connection concrete;

said slab concrete is rigidly joined together with said third concrete bridge pier by said connection concrete;

third connecting bars are embedded in said third concrete bridge pier and extend upwardly therefrom;

said third connecting bars extend upwardly and project through said bridge girder support middle portions of said bridge girders;

third stoppers are provided at upper end portions of said third connecting bars, said third stoppers being secured to said upper end portions of said third connecting bars and being engaged with said upper sides of said bridge girders to anchor and connect each of said bridge girders to said third concrete bridge pier.

14. The floor slab bridge structure according to claim 13, wherein said third stoppers comprise nuts threaded onto threaded portions of said upper end portions of said third connecting bars.

15. The floor slab bridge structure according to claim 1, further comprising elongated seat plates supported on said upper surfaces of adjacent ones of said bridge girders so as to span between said adjacent ones of said bridge girders; and additional connecting bars embedded in said first and second concrete bridge piers and extending upwardly therefrom;

wherein said additional connecting bars extend upwardly between said adjacent ones of said bridge girders and project through said elongated seat plates; and wherein additional stoppers are provided at upper end portions of said additional connecting bars, said additional stoppers being secured to said upper end portions of said additional connecting bars and being engaged with upper sides of said elongated seat plates.

16. The floor slab bridge structure according to claim 15, wherein said additional stoppers comprise nuts threaded onto threaded portions of said upper end portions of said additional connecting bars.

* * * * *